US008606127B2

(12) United States Patent
Hayakawa

(10) Patent No.: US 8,606,127 B2
(45) Date of Patent: Dec. 10, 2013

(54) IMAGE FORMING APPARATUS WHICH CAN SUPPRESS A REVERSE TRANSFER WHEN EXECUTING MONOCHROME PRINTING

(75) Inventor: Masahiko Hayakawa, Ama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 402 days.

(21) Appl. No.: 13/040,582

(22) Filed: Mar. 4, 2011

(65) Prior Publication Data

US 2011/0293301 A1 Dec. 1, 2011

(30) Foreign Application Priority Data

May 31, 2010 (JP) ..... 2010-124245

(51) Int. Cl.
*G03G 15/00* (2006.01)
*G03G 15/02* (2006.01)
*G03G 15/16* (2006.01)

(52) U.S. Cl.
USPC ..... 399/44; 399/50; 399/66

(58) Field of Classification Search
USPC ..... 399/44, 50, 228, 298, 299, 302, 66
See application file for complete search history.

(56) References Cited

U.S. PATENT DOCUMENTS

| | | | | |
|---|---|---|---|---|
| 7,058,326 | B2 * | 6/2006 | Toyama | 399/50 |
| 7,526,235 | B2 | 4/2009 | Furukawa | |
| 7,907,855 | B2 | 3/2011 | Akita | |
| 8,005,387 | B2 * | 8/2011 | Nishiwaki et al. | 399/299 |
| 8,099,010 | B2 | 1/2012 | Miyahara | |
| 8,285,161 | B2 * | 10/2012 | Furukawa et al. | 399/302 |
| 2006/0072941 | A1 | 4/2006 | Furukawa | |
| 2008/0193152 | A1 | 8/2008 | Akita | |
| 2008/0317506 | A1 | 12/2008 | Furukawa | |
| 2009/0297183 | A1 | 12/2009 | Miyahara | |
| 2010/0080588 | A1 | 4/2010 | Fujikura | |

FOREIGN PATENT DOCUMENTS

| | | | |
|---|---|---|---|
| JP | 2000-242094 | | 9/2000 |
| JP | 2002-333753 | A | 11/2002 |
| JP | 2002-357939 | A | 12/2002 |
| JP | 2003-280318 | A | 10/2003 |
| JP | 2004-012524 | | 1/2004 |
| JP | 2006-098508 | A | 4/2006 |
| JP | 2007-171633 | A | 7/2007 |

(Continued)

OTHER PUBLICATIONS

JP Office Action dtd Apr. 10, 2012, JP Appln. 2010-124245, English translation.

*Primary Examiner* — William J Royer
(74) *Attorney, Agent, or Firm* — Banner & Witcoff, Ltd.

(57) ABSTRACT

An image forming apparatus for printing an image on a medium, including: a first image carrier; a second image carrier disposed downstream of the first image carrier in a traveling direction of the medium; a first charging member configured to charge the first image carrier; a second charging member configured to charge the second image carrier; and a control unit configured to execute a monochrome printing mode in which a monochromic image is formed on the medium using the first image carrier and the first charging member and a color printing mode in which a color image is formed on the medium using the second image carrier and the second charging member. In the monochrome printing mode, the control unit makes an absolute value of an electric surface potential of the second image carrier larger than an absolute value of an electric surface potential of the first image carrier.

11 Claims, 6 Drawing Sheets

(56) References Cited

FOREIGN PATENT DOCUMENTS

| | | | |
|---|---|---|---|
| JP | 2008-197464 | A | 8/2008 |
| JP | 2009-003377 | | 1/2009 |
| JP | 2009-288550 | A | 12/2009 |
| JP | 2010-085666 | A | 4/2010 |

* cited by examiner

FIG. 4

| | ELECTRIC SURFACE POTENTIAL (V) | | | |
|---|---|---|---|---|
| | FIRST | SECOND | THIRD | FOURTH |
| COLOR PRINTING MODE | 760 | 760 | 760 | 760 |
| MONOCHROME PRINTING MODE | 760 | 900 | 760 | 760 |

FIG. 5

| | ELECTRIC SURFACE POTENTIAL (V) | | | |
|---|---|---|---|---|
| | FIRST | SECOND | THIRD | FOURTH |
| COLOR PRINTING MODE | 760 | 760 | 760 | 760 |
| MONOCHROME PRINTING MODE | 760 | 900 | 900 | 900 |

FIG. 6

| | ELECTRIC SURFACE POTENTIAL (V) | | | |
|---|---|---|---|---|
| | FIRST | SECOND | THIRD | FOURTH |
| COLOR PRINTING MODE | 760 | 760 | 760 | 760 |
| MONOCHROME PRINTING MODE | 760 | 900 | 850 | 850 |

FIG. 7

| | ELECTRIC SURFACE POTENTIAL (V) | | | |
|---|---|---|---|---|
| | FIRST | SECOND | THIRD | FOURTH |
| COLOR PRINTING MODE | 760 | 760 | 760 | 760 |
| MONOCHROME PRINTING MODE | 700 | 760 | 760 | 760 |

FIG. 9

| | ELECTRIC SURFACE POTENTIAL (V) | | | |
|---|---|---|---|---|
| | FIRST | SECOND | THIRD | FOURTH |
| COLOR PRINTING MODE | 760 | 760 | 760 | 760 |
| MONOCHROME PRINTING MODE (NORMAL HUMIDITY) | 760 | 800 | 800 | 800 |
| MONOCHROME PRINTING MODE (HIGH HUMIDITY) | 760 | 900 | 900 | 900 |

FIG. 10

| | ELECTRIC SURFACE POTENTIAL (V) | | | |
|---|---|---|---|---|
| | FIRST | SECOND | THIRD | FOURTH |
| COLOR PRINTING MODE AND MONOCHROME PRINTING MODE (NORMAL HUMIDITY) | 760 | 760 | 760 | 760 |
| MONOCHROME PRINTING MODE (HIGH HUMIDITY) | 760 | 900 | 900 | 900 |

FIG. 11

| | TRANSFER CURRENT (μA) | | | |
|---|---|---|---|---|
| | FIRST | SECOND | THIRD | FOURTH |
| MONOCHROME PRINTING MODE (NORMAL HUMIDITY) | -15 | -17 | -12 | -9 |
| MONOCHROME PRINTING MODE (HIGH HUMIDITY) | -15 | -25 | -20 | -10 |

IMAGE FORMING APPARATUS WHICH CAN SUPPRESS A REVERSE TRANSFER WHEN EXECUTING MONOCHROME PRINTING

This application is based upon and claims the benefit of priority of Japanese Patent Application No. 2010-124245 filed on May 31, 2010, the contents of which are incorporated herein by reference in its entirety.

BACKGROUND

The disclosure relates to an image forming apparatus which can execute monochrome printing and color printing.

Generally, as an electrophotographic image forming apparatus, there has been known an image forming apparatus comprising developing devices which contain toner of predetermined colors and photosensitive drums which correspond to the predetermined colors, wherein toner images formed on the photosensitive drums by supplying the toner from the developing devices are transferred to a sheet. In this image forming apparatus, the photosensitive drum for monochrome printing (normally, in black) is disposed at an upstreammost end of a sheet conveying direction. In executing monochrome printing, a toner image is formed only on the photosensitive drum for monochrome printing for transfer onto a sheet.

SUMMARY

However, when monochrome printing is executed, the photosensitive drums for color printing which are disposed further downstream in the sheet conveying direction than the photosensitive drum for monochrome printing come into contact with the monochrome toner image formed on the sheet, as a result of which there may occur a situation in which the toner on the sheet adheres to the color printing photosensitive drums (hereinafter, referred to as reverse transfer). When a reverse transfer like this occurs, there is caused a problem that the toner which has been carried or transferred to the color printing photosensitive drums by the reverse transfer is retransferred onto the following sheet onto which a monochrome toner image is formed, thereby product a ghost image.

Then, one aspect of the disclosure is to provide an image forming apparatus which can suppress the reverse transfer when monochrome printing is executed.

One aspect of the disclosure provides an image forming apparatus for printing an image on a medium, comprising:

a first image carrier;

a second image carrier disposed downstream of the first image carrier in a traveling direction of the medium;

a first charging member configured to charge the first image carrier;

a second charging member configured to charge the second image carrier; and a control unit configured to execute a monochrome printing mode in which a monochromic image is formed on the medium using the first image carrier and the first charging member and a color printing mode in which a color image is formed on the medium using the second image carrier and the second charging member, wherein in the monochrome printing mode, the control unit makes an absolute value of an electric surface potential of the second image carrier larger than an absolute value of an electric surface potential of the first image carrier.

BRIEF DESCRIPTION OF THE DRAWINGS

FIG. 4 is a map showing a form in which an electric surface potential of the photosensitive drum for a second color only is increased.

FIG. 5 is a map showing a form in which electric surface potentials of all the photosensitive drums for the second color and colors thereafter are increased.

FIG. 6 is a map showing a form in which there is provided a difference between the electric surface potential of the photosensitive drum for the second color and the electric surface potentials of all the photosensitive drums for the third color and the color thereafter.

FIG. 7 is a map showing a form in which an electric surface potential of the photosensitive drum for a first color is decreased.

FIG. 9 is a map showing a form in which the electric surface potentials of the photosensitive drum for the second color and the photosensitive drums for the colors thereafter are increased when humidity is higher than normal in a monochrome printing mode.

FIG. 10 is a map showing a form in which the electric surface potentials of all the photosensitive drums are made the same between when humidity is normal in a monochrome printing mode and when a color printing mode is executed.

FIG. 11 is a map showing a form in which an absolute value of a transfer bias (transfer current) is increased when humidity is higher than normal in a monochrome printing mode.

DESCRIPTION OF EXEMPLARY EMBODIMENTS

Figure 1:
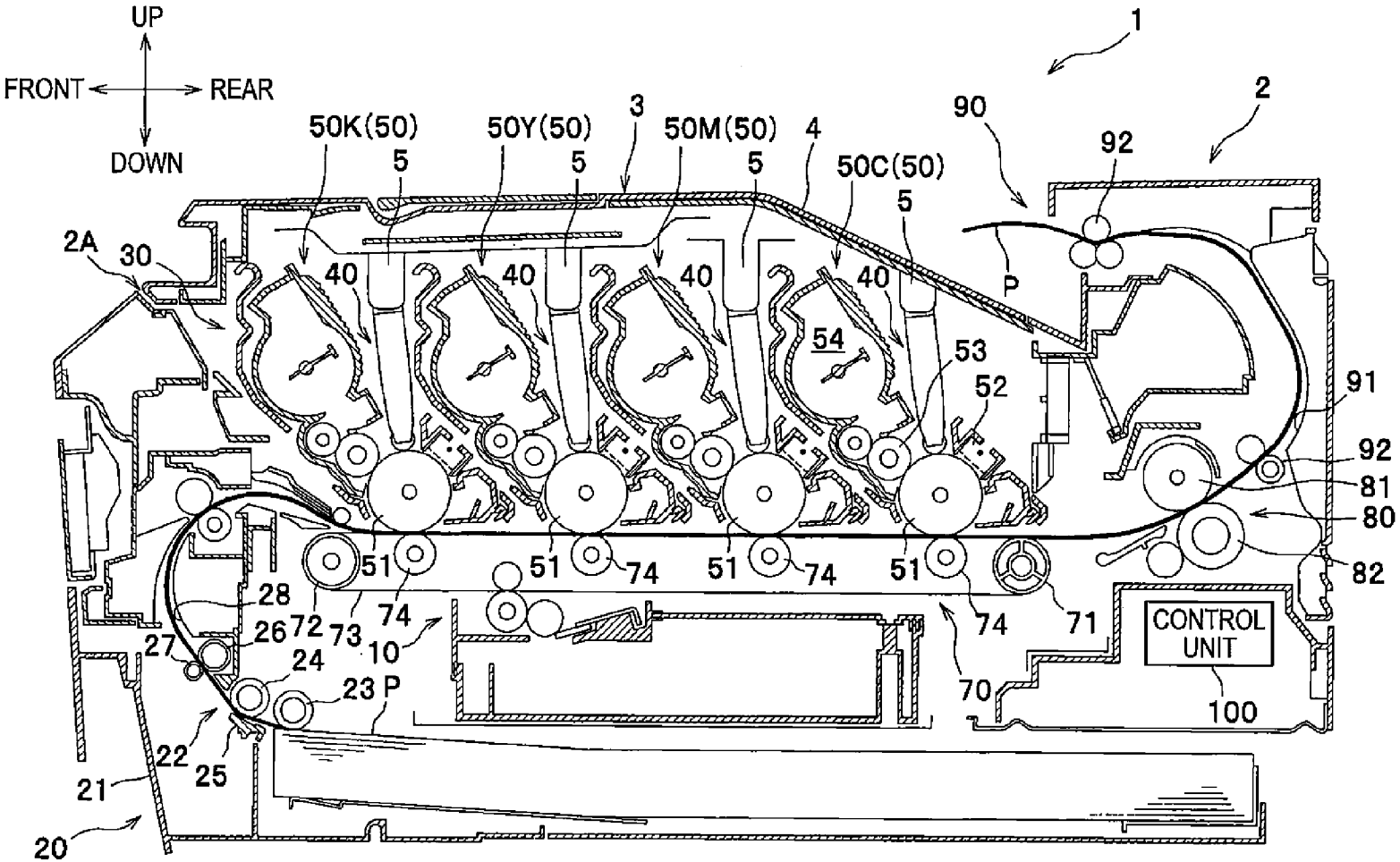
FIG. 1 is a side sectional view of an image forming apparatus according to an exemplary embodiment.

Next, an exemplary embodiment will be described in detail while referring to the drawings as required. In the next description, firstly, an overall configuration of a color printer will be described, and then characteristic portions of the exemplary embodiment will be described in detail.

In the following description, directions will be described based on the position of a user of a color printer. Namely, in FIG. 1, with the user standing to face the drawing on which a side sectional view of a color printer is drawn, a left-hand side of the figure is referred to as a "front side," a right-hand side as a "rear side," a farther side as a "left-hand side," and a nearer side as a "right-hand side" of the color printer. In addition, Upward and downward directions of the figure are referred to as "upward and downward directions" of the color printer.

As is shown in FIG. 1, a color printer 1 includes a feeder unit 20 for feeding a sheet P as an example of a medium (a medium receiving a transferred image), an image forming unit 30 for forming an image on the sheet P fed, a sheet discharge part 90 for discharging the sheet P on which an image is formed and a control unit 100 within an apparatus main body 2.

An opening portion 2A is formed in an upper portion of the apparatus main body 2. The opening portion 2A is designed to be opened and closed by an upper cover 3 which is supported rotatably on the apparatus main body 2. An upper surface of the upper cover 3 is configured as a sheet discharging tray 4 where sheets P discharged from the apparatus main body 2 are accumulated. A plurality of LED mounting members 5 are provided on a lower surface of the upper cover 3, and LED units 40, which will be described later, are held on the LED mounting members 50.

The feeder unit 20 is provided at a lower portion within the apparatus main body 2 and includes a sheet feeding tray 21 which is detachably installed in the apparatus main body 2 and a sheet feeding mechanism 22 for conveying a sheet P from the sheet feeding tray 21 to the image forming unit 30. The sheet feeding mechanism 22 is provided at a front side of the sheet feeding tray 21 and includes a sheet feeding roller 23, a separation roller 24 and a separation pad 25.

In the sheet feeder unit 20 configured in the way described above, sheets P in the sheet feeding tray 21 are separated to be sent upwards sheet by sheet, and paper dust is removed therefrom while the sheet P is passing between a paper dust removing roller 26 and a pinch roller 27. Thereafter, the sheet P passes through a conveying path 28 to thereby be turned to a reverse direction so as to be fed to the image forming unit 30.

The image forming unit 30 includes mainly four LED units 40, four process cartridges 50, a transfer unit 70, a cleaning part 10 and a fixing unit 80.

The LED units 40 are connected to the LED mounting members 5 so as to swing thereon and are supported while being positioned as required by a positioning member provided in the apparatus main body 2.

The process cartridges 50 are disposed to be aligned in a front-rear direction between the upper cover 3 and the feeder unit 20 and each include a photosensitive drum 51 as an example of an image carrier, a charger 52 as an example of a charging member, a developing roller 53, a toner containing chamber 54 for containing toner as an example of a developer.

The process cartridges 50 are denoted by 50K, 50Y, 50M and 50C as containing black toner, yellow toner, magenta toner and cyan toner, respectively, and are aligned sequentially in this order from an upstream side of the conveying direction of sheet P (the moving direction of a recording medium). In the specification and the drawings, when specifying the photosensitive drums 51, the chargers 52, the developing rollers 53 and transfer rollers 74 in accordance with the toner colors, reference characters K, Y, M, C are added thereto so as to make them correspond to black, yellow, magenta and cyan, respectively, or words denoting order such as first, second, third and fourth may be put before the designations of those members in that order from the upstream side from time to time.

Namely, for example, the photosensitive drums 51 may be referred to from time to time as the first photosensitive drum 51K (the first image carrier), the second photosensitive drum 51Y (the second image carrier), the third photosensitive drum 51M ((he third image carrier), and the fourth photosensitive drum (the fourth image carrier) sequentially from the upstream side.

Figure 2:
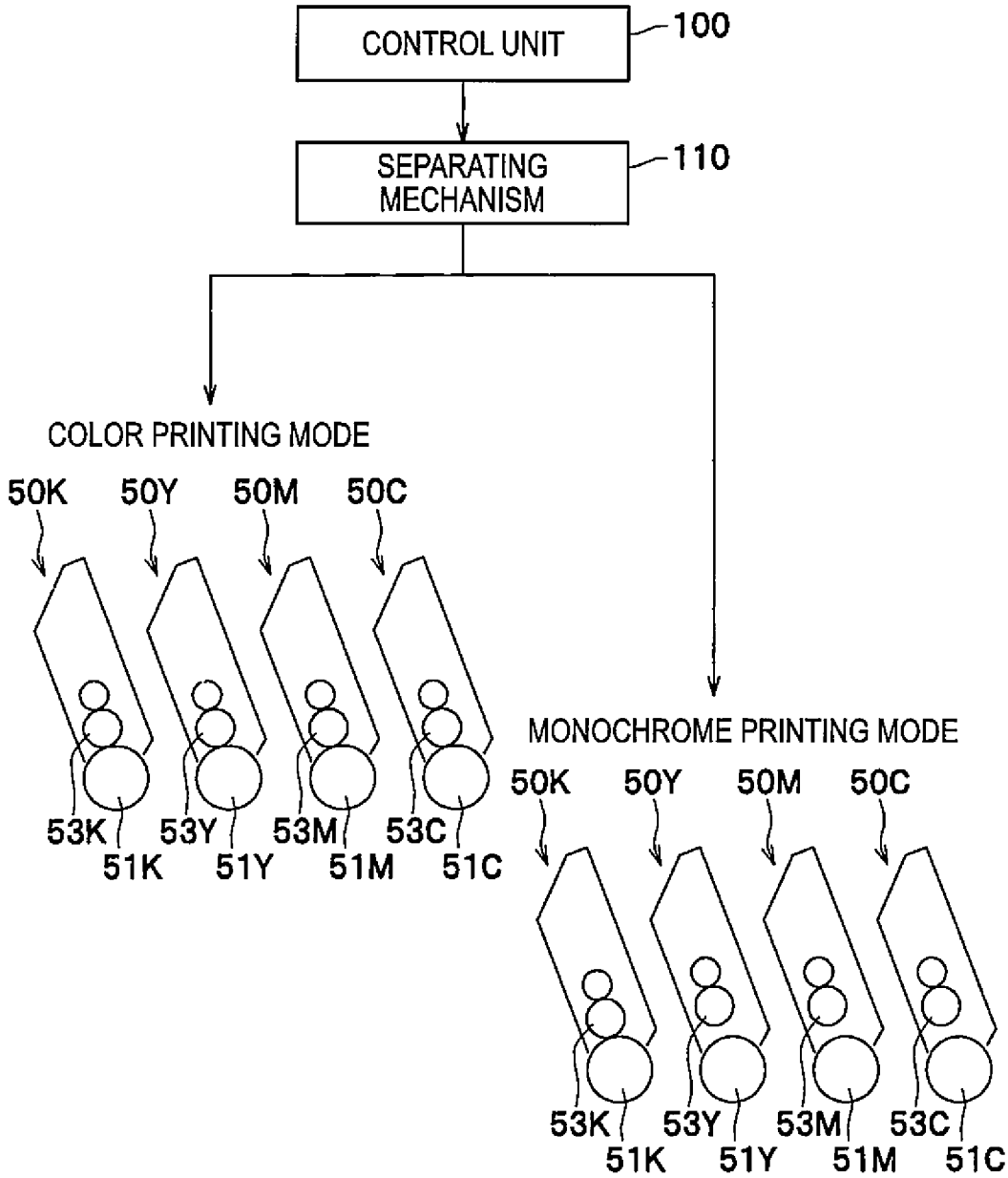
FIG. 2 is a drawing explaining the separation of photosensitive drums from developing rollers.

As is shown in FIG. 2, the developing rollers 53 are allowed to move towards or away from the corresponding photosensitive drums 51 by controlling a known separating mechanism 110 (similar to a switching mechanism described in JP2009-3377A which is incorporated herein by reference) by the control unit 100. Specifically, in a color printing mode, all the developing rollers 53K, 53Y, 53M, 53C are brought into contact with the corresponding photosensitive drums 51K, 51Y, 51M, 51C, respectively, so as to supply the toner of colors corresponding to the photosensitive drums 51K, 51Y, 51M, 51C. In addition, in a monochrome printing mode, only the first developing roller 53K for black (monochromic color) is brought into contact with the first photosensitive drum 51K, while the developing rollers 53Y, 53M, 53C for the remaining three colors are kept staying away from the corresponding photosensitive drums 51Y, 51M, 51C.

As is shown in FIG. 1, the transfer unit 70 is provided between the feeder unit 20 and the process cartridges 50 and includes a driving roller 71, a driven roller 72, a conveying belt 73 and transfer rollers 74 as an example of a transfer member.

The driving roller 71 and the driven roller 72 are disposed in parallel while being spaced away from each other in the front-rear direction, and the conveying belt 73, which is made up of an endless belt, is provided to extend therebetween. An external surface of the conveying belt 73 is brought into contact with the photosensitive drums 51. Four transfer rollers 74 are provided inside the conveying belt 73 so as to be disposed to face the corresponding photosensitive drums 51 to thereby hold the conveying belt 73 together with those photosensitive drums 51. A transfer bias (a transfer voltage) having a polarity opposite to the polarity of the toner charged is applied to the transfer rollers 74 at the time of transfer by a constant-current control.

The fixing unit 80 is disposed at the rear of the process cartridges 50 and the transfer unit 70 and includes a heating roller 81 and a pressing roller 82 which is disposed so as to face the heating roller 81 to thereby press the same heating roller 81.

In the image forming unit 30 configured in the way described above, in the case of the color printing mode, firstly the surfaces of the photosensitive drums 51 are uniformly charged by the corresponding chargers 52 and thereafter are exposed by the corresponding LED units 40. By this exposure, the electric potentials of portions of the photosensitive drums 51 which are so exposed are decreased, whereby electrostatic latent images based on image data are formed on the photosensitive drums 51. Thereafter, toner images are carried on the photosensitive drums 51 by the toner being supplied to the electrostatic latent images by the developing rollers 53.

By passing a sheet P, that is fed onto the conveying belt 73, between the photosensitive drums 51 and the corresponding transfer rollers 74 which are disposed inside the conveying belt 73, the toner images formed on the photosensitive drums 51 are transferred onto the sheet P. Then, by passing the sheet P between the heating roller 81 and the pressing roller 82, the toner images transferred onto the sheet P are thermally fixed.

The sheet discharge part 90 includes a discharge-side conveying path 91 which extends upwards from an exit of the fixing unit 80 to be turned to the front and a plurality of pairs of conveying rollers 92 for conveying a sheet P. The sheet P on which the toner images are thermally fixed is conveyed along the discharge-side conveying path 91 by the pairs of conveying rollers 92 to be discharged out of the apparatus main body 2 and is accumulated in the sheet discharging tray 4.

Figure 3:
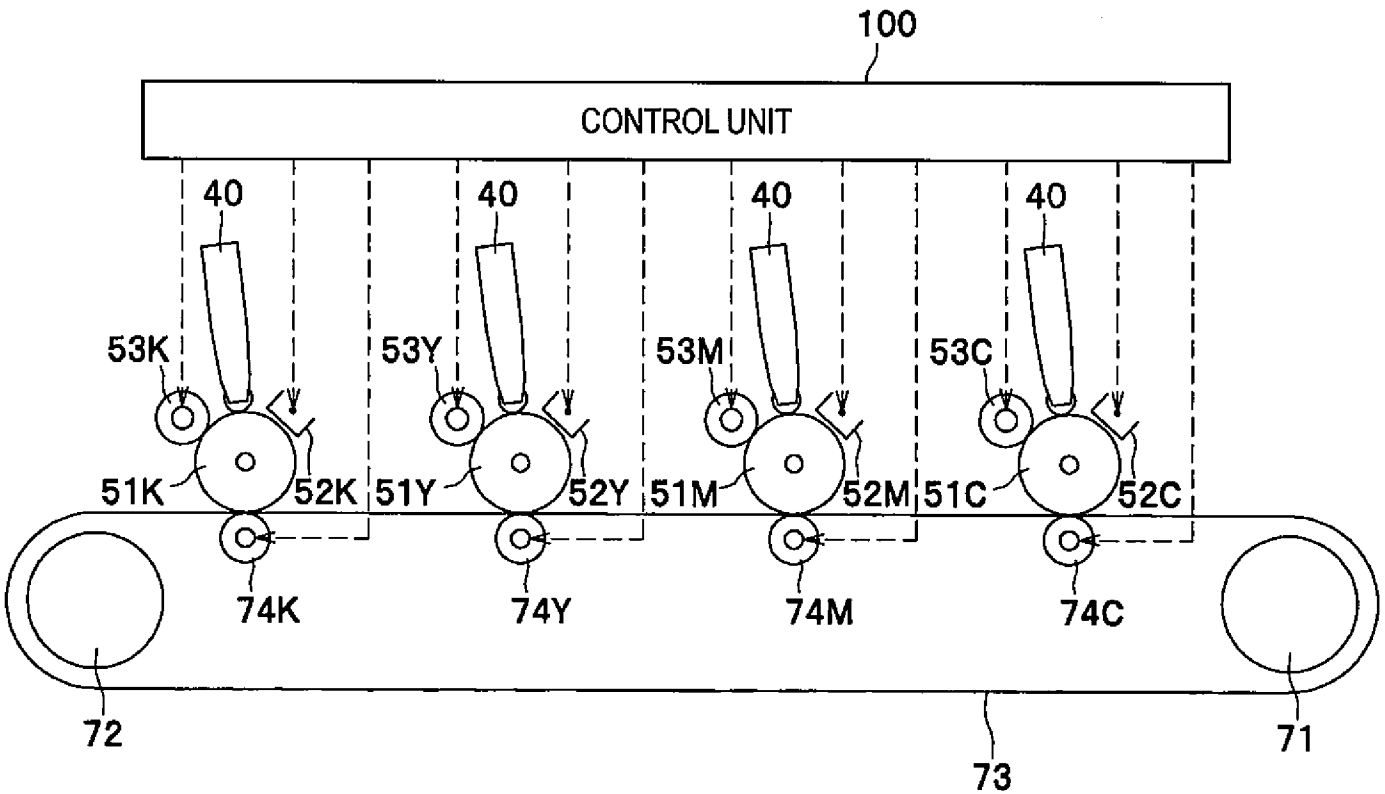
FIG. 3 is a drawing explaining the application of voltage to the developing rollers, chargers and transfer rollers by a control unit.

The control unit 100 has a CPU, ROM, RAM and the like and is made to control the reception of printing data, the feeder unit 20, the image forming unit 30, the sheet discharge part 90 and the separating mechanism 110 in accordance with a prepared program. Specifically, the control unit 100 can execute a monochrome printing in which a monochromic image is formed on a sheet P (hereinafter, referred to as a monochrome printing mode) and a color printing mode in which a color image is formed on a sheet P (hereinafter, referred to as a color printing mode) and controls voltages to be applied to the developing rollers 53, the chargers 52 and the transfer rollers 74 as required in either mode as is shown in FIG. 3.

The control unit 100 controls the chargers 52 so as to change respective electric surface potentials of the photosensitive drums 51 (for example, from 0 V to 760 V), and particularly in the monochrome printing mode, the control unit 100 executes a special control which will be described below.

<Control of Chargers>

Next, the controlling of charging bias (charging voltage) to be applied to the chargers 52 by the control unit 100 will be described.

Note that in this embodiment, although the exemplary embodiment will be described as being applied to positively chargeable toner, the exemplary embodiment can equally be applied to negatively chargeable toner. The polarity of charging bias is set as required in accordance with the polarity of charged toner. In addition, in this embodiment, voltages are applied to the developing rollers 53 and the transfer rollers 74 as required by the known control, and therefore, the application of voltages thereto by use of the known control will not be described herein.

A charging bias is a voltage to control an electric potential by which the photosensitive drum 51 is charged and is applied to the charger 52 (the grid) which corresponds to the photosensitive drum 51 to be charged. Specifically, the control unit 100 controls a charging bias that is applied to the chargers 52 based on a map shown in 4.

As is shown in FIG. 4, in the color printing mode, the control unit 100 controls so that all the electric surface potentials of the photosensitive drums 51 take the same value (for example, 760 V) by applying charging biases of the same value to the chargers 52.

When executing the monochrome printing mode, the control unit 100 applies a charging bias to the second charger 52Y which is larger than a charging bias applied thereto in the color printing mode so that an absolute value of the electric surface potential of the second photosensitive drum 51Y becomes a larger value (for example, 900 V) than an absolute value of the electric surface potential of the first photosensitive drum 51K. By doing so, the black toner transferred to a sheet P from the first photosensitive drum 51K in the monochrome printing mode is restrained from being reversely transferred to the photosensitive drums 51Y, 51M, 51C aligned thereafter.

According to the configuration described above, the following advantage can be obtained in this embodiment.

Since the control unit 100 makes the absolute value of the electric surface potential of the second photosensitive drum 51Y larger than the absolute value of the electric surface potential of the first photosensitive drum 51K in the monochrome printing mode, a potential difference between the second photosensitive drum 51Y and the sheet P becomes larger than a potential difference between the first photosensitive drum 51K and the sheet P, whereby the toner is attracted to the sheet P. By the toner being so attracted, the reverse transfer of toner to the second photosensitive drum 51Y can be restrained.

Note that the invention does not have to be limited to the embodiment and hence can be used in various forms, which will be described below.

In the embodiment, while only the electric surface potential of the second photosensitive drum 51Y is made larger than the electric surface potential of the first photosensitive drum 51K in the monochrome printing mode, the invention is not limited thereto. For example, as is shown in FIG. 5, in the monochrome printing mode, absolute values of electric surface potentials of all the other photosensitive drums than the first photosensitive drum 51K (that is, the second photosensitive drum 51Y, the third photosensitive drum 51M and the fourth photosensitive drum 51C) may be made larger than an absolute value of electric surface potential of the first photosensitive drum 51K. Namely, in the monochrome printing mode, charging biases applied to the second photosensitive drum 51Y, the third photosensitive drum 51M and the fourth photosensitive drum 51C) may be made larger than a charging bias applied to the first photosensitive drum 51K. By doing so, the reverse transfer to the photosensitive drums for the third and fourth colors can be restrained further.

In addition, as is shown in FIG. 6, in the monochrome printing mode, absolute values of electric surface potentials of the third photosensitive drum 51M and the fourth photosensitive drum 51C may be made smaller than an absolute value of electric surface potential of the second photosensitive drum 51Y and larger than an absolute value of electric surface potential of the first photosensitive drum 51K. By doing so, the reverse transfer due to charge-up of toner can be restrained.

Here, the "charge-up" means that the toner on the sheet gets charged stronger step by step every time it passes the photosensitive drum 51. Then, when the charge-up occurs, discharge occurs between toner particles and toner and sheet due to overcharging, leading from time to time to the generation of negatively charged toner. When the negatively charged toner is generated in this way, since the reverse transfer of toner is caused on the photosensitive drums 51 for the third and fourth colors, the charge-up of toner is restrained by making smaller the electric surface potentials of the photosensitive drums 51 for the third and fourth colors.

In the embodiment, while in the monochrome printing mode, the electric surface potential of the second photosensitive drum 51Y is made larger than the electric surface potential that is applied thereto in the color printing mode, the invention is not limited thereto. For example, as is shown in FIG. 7, in the monochrome printing mode, by making the electric surface potential of the first photosensitive drum 51K smaller than that in the color printing mode, the electric surface potential of the second photosensitive drum 51Y may be made larger relatively than the electric surface potential of the first photosensitive drum 51K. Also in this case, the reverse transfer can be restrained further than a form in which the electric surface potentials of all the photosensitive drums 51 are decreased down to 700 V. However, as in the embodiment, when the electric surface potential of the second photosensitive drum 51Y in the monochrome printing mode is made larger than that in the color printing mode, the reverse transfer can restrained much further.

Figure 8:
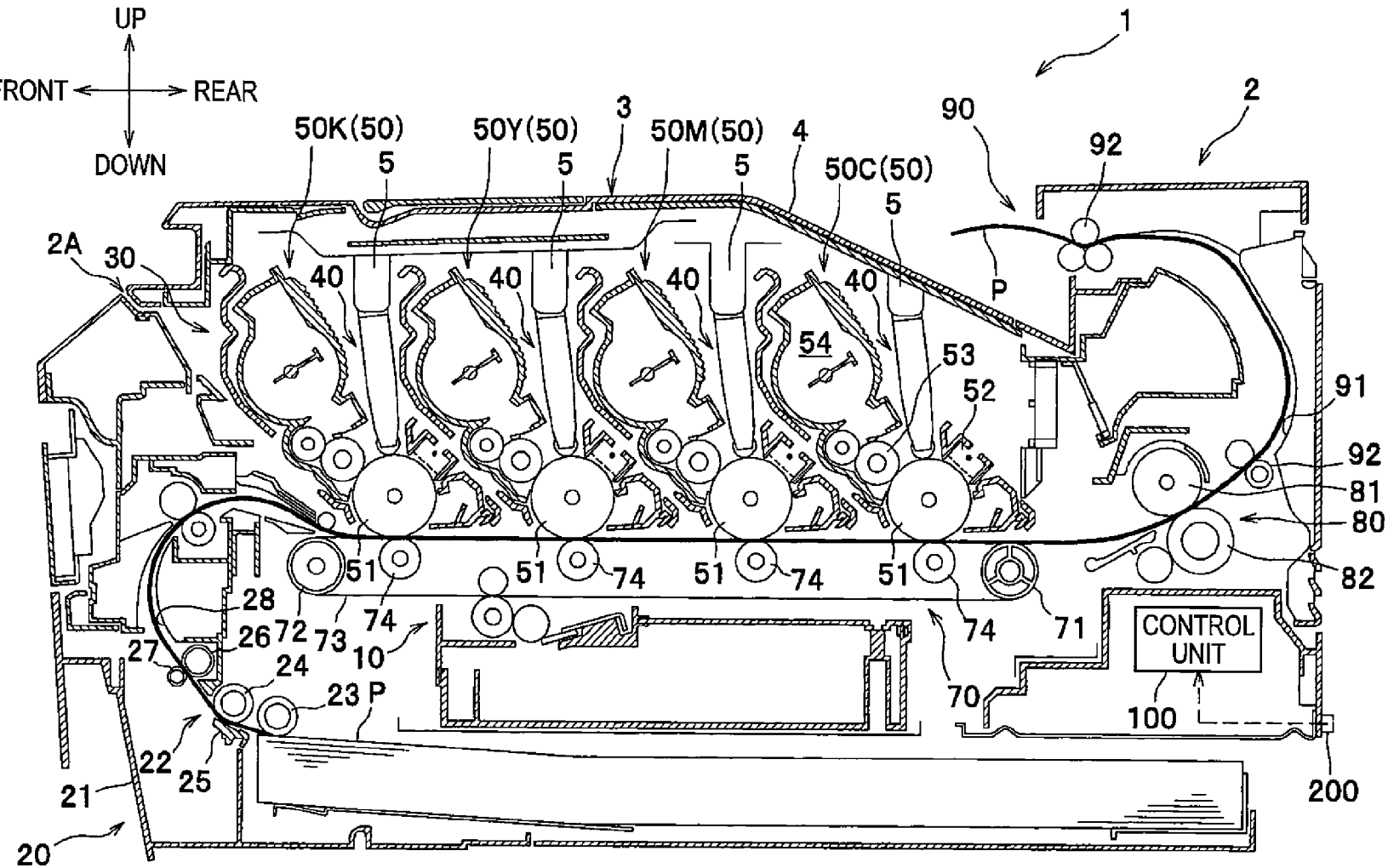
FIG. 8 is a side sectional view showing an image forming apparatus which includes a humidity sensor.

In addition, as is shown in FIG. 8, a humidity sensor 200, which is an example of a detection device, is provided on the apparatus main body 2, and charging biases may be controlled based on a humidity outside the apparatus main body 2 detected by the humidity sensor 200. Specifically, for example, as is shown in FIG. 9, in the monochrome printing mode, when a humidity detected by the humidity sensor 200 is equal to or larger than a predetermined value (high humidity), the control unit 100 makes absolute values of electric surface potentials of the second photosensitive drum 51Y, the third photosensitive drum 51M and the fourth photosensitive drum 51C larger than those when the humidity is smaller than the predetermined value (normal humidity).

Namely, when the humidity is normal in the monochrome printing mode, the absolute values of electric surface potentials of the photosensitive drums 51Y, 51M, 51C may be made to take a smaller value (for example, 800 V) than that of the first photosensitive drum 51K. On the contrary, when the humidity is high in the monochrome printing mode, the absolute values of electric surface potentials of the photosensitive drums 51Y, 51M, 51C may be made to take a larger value, which is 900 V, than the absolute value (800 V) when the humidity is normal. This is because even in case electric charge escapes from the toner transferred to a recording medium in a high humidity environment, the amount of electric charge that has so escaped can be compensated for by obtaining electric charges from the second photosensitive drum 51Y, the third photosensitive drum 51M and the fourth photosensitive drum 51C. According to this configuration, the reverse transfer can be restrained further in the high humidity environment where the reverse transfer tends to be generated easily. As the detection device, a humidity sensor for detecting humidity inside the apparatus main body may be adopted.

Additionally, as is shown in FIG. 10, when the humidity is normal in the monochrome printing mode, as in the color printing mode, the electric surface potentials of all the photosensitive drums 51 may be the same value, while when the humidity is equal to or larger than a predetermined value (high humidity) in the monochrome printing mode, absolute values of electric surface potentials of the photosensitive drums 51Y, 51M, 51C may be a larger value than an absolute value of electric surface potential of the first photosensitive drum 51K.

In the forms shown in FIGS. 5, 9 and 10, while the electric surface potentials of all the second photosensitive drum 51Y, the third photosensitive drum 51M and the fourth photosensitive drum 51C are made larger than that of the first photosensitive drum 51K, the invention is not limited thereto. Namely, for example, the electric surface potentials of only the second photosensitive drum 51Y and the third photosensitive drum 51M may be made so larger, or the electric surface potentials of only the second photosensitive drum 51Y and the fourth photosensitive drum 51C may be made so larger.

In addition, as is shown in FIG. 11, when the humidity detected by the humidity sensor 200 is equal to or larger than the predetermined value (high humidity) in the monochrome printing mode, absolute values of transfer biases (transfer currents) to be applied to the second transfer roller 74Y, the third transfer roller 74M and the fourth transfer roller 74C may be made larger than those when the humidity is smaller than the predetermined value (normal humidity). Here, in FIG. 11, although transfer biases are represented by transfer currents, since transfer current and transfer voltage are in a proportional relationship, it will be no problem that numerical values in the table are understood to be shown in transfer voltage. Then, since potential differences between the transfer rollers 74 and the photosensitive drums 51 for the second color and the colors thereafter when the humidity is high become large by making the transfer voltages when the humidity is high larger than those when the humidity is normal, the reverse transfer can be restrained further.

In the embodiment, while the four photosensitive drums 51 are provided so as to correspond to the toner of four colors, the invention is not limited thereto. For example, when toner comes in three colors, three photosensitive drums may be provided so as to correspond to the three colors, or when toner comes in five or more colors, five or more photosensitive drums may be provided so as to correspond to those five or more colors.

In the embodiment, while the one photosensitive drum is used to print a black image or the like, the invention is not limited thereto. For example, the three photosensitive drums for yellow, magenta and cyan may be used to print a black image or the like. As this occurs, the three photosensitive drums for those three colors which are used to print a black image or the like correspond to the first image carrier, and other photosensitive drums for other colors (for example, light magenta, light cyan and the like) which are disposed downstream thereof correspond to the second image carrier.

In the embodiment, while sheets P are described as functioning as a medium receiving a transferred image, the invention is not limited thereto. The medium may be an intermediate transfer belt, for example.

In the embodiment, while the photosensitive drums 51 are described as functioning as an image carrier, the invention is not limited thereto, and hence, a belt-shaped photosensitive material may be adopted.

In the embodiment, while the chargers 52 having a charging wire are described as functioning as a charging member, the invention is not limited thereto, and hence, the charging member may be, for example, a charging roller which is brought into contact with the photosensitive drum to charge the photosensitive drum.

In the embodiment, while the transfer rollers 74 are described as functioning as a transfer member, the invention is not limited thereto, and hence, a transfer member in any form such as a conductive brush or a conductive spring may be adopted as the transfer member, provided that a transfer bias can be applied thereto.

In the embodiment, while the color printer is described as functioning as an image forming apparatus, the invention can also be applied to a multifunction device or a copier.

In the embodiment, while the separating mechanism 110 is provided, the invention is not limited thereto, and hence, no separating mechanism may be provided. Even in such a case, an advantage can be exhibited that color mixing in the toner containing chambers for the second color and colors thereafter can be restrained by restraining the reverse transfer to the photosensitive drums for the second color and colors thereafter.

In addition, the transfer bias control method may be implemented based on the constant current control or a constant voltage control. Here, the constant current control means a method in which a current which flows to the transfer roller is detected and the transfer voltage is controlled so that the current becomes constant. In this method, although it is considered that when the electric surface potential of the photosensitive drum is increased, an absolute value of a transfer voltage to be applied to the transfer roller is decreased as the electric surface potential of the photosensitive drum is increased so that a potential difference between the photosensitive drum and the transfer roller cannot be increased, it is verified by experiments carried out by the inventor that the potential difference is increased in the high humidity environment in which the reverse transfer tends to be generated easily.

Namely, in the high humidity environment, a leakage of transfer current (a phenomenon in which part of transfer current flows to a sheet) is generated by a reduction in resistance in a sheet which has absorbed moisture, and a transfer current value being detected becomes smaller than a value of current which flows to the photosensitive drum. Therefore, it is considered that the potential difference between the photosensitive drum and the transfer roller becomes small.

However, when the electric surface potential of the photosensitive drum is increased, a potential difference between the photosensitive drum and the earth (0 V) becomes large, whereby a large current flows to the photosensitive drum, and the leakage of transfer current is decreased. As a result, it is considered that the potential difference between the photosensitive drum and the transfer roller is increased.

Because of this, the advantage of the invention can be exhibited well even when the transfer bias control method is implemented based on the constant current control. Note that the constant voltage control means a control in which a transfer bias (a transfer voltage) that is applied to the transfer roller is made constant, and the transfer bias is not changed by a change in electric surface potential, and therefore, the advantage of the invention can be exhibited in an ensured fashion.

What is claimed is:

1. An image forming apparatus for printing an image on a medium, comprising:

a first image carrier;

a second image carrier disposed downstream of the first image carrier in a traveling direction of the medium;

a first charging member configured to charge the first image carrier;

a second charging member configured to charge the second image carrier; and a control unit configured to control the first and second charging members and execute a monochrome printing mode in which a monochromic image is formed on the medium using the first image carrier and the first charging member and a color printing mode in which a color image is formed on the medium using the second image carrier and the second charging member, wherein in the monochrome printing mode, the control unit is configured to control the first or second charging members so that an absolute value of an electric surface potential of the second image carrier is larger than an absolute value of an electric surface potential of the first image carrier.

2. The image forming apparatus according to claim 1 further comprising:

a third image carrier disposed downstream of the second image carrier in the traveling direction; and a third charging member for charging the third image carrier, wherein the control unit is configured to execute the color printing mode using the third image carrier and the third charging member, and wherein in the monochrome printing mode, the control unit is configured to control the third charging member so as to make an absolute value of an electric surface potential of the third image carrier larger than the absolute value of the electric surface potential of the first image carrier.

3. The image forming apparatus according to claim 2, wherein in the monochrome printing mode, the absolute value of the electric surface potential of the third image carrier is smaller than the absolute value of the electric surface potential of the second image carrier.

4. The image forming apparatus according to claim 2 further comprising a detection device configured to detect humidity, wherein in the monochrome printing mode, the control unit is configured to control the third charging member so that the absolute value of the electric surface potential of the third image carrier at a time the humidity detected by the detection device is equal to or larger than a value is larger than the absolute value of the electric surface potential of the third image carrier at a time the humidity detected by the detection device is smaller than the value.

5. The image forming apparatus according to claim 4, comprising:

a third transfer member configured to transfer a developer image formed on the third image carrier to the medium by a transfer bias whose polarity differs from a charged polarity of a developer on the third image carrier, wherein wherein in the monochrome printing mode, the control unit is configured to control the third transfer member so that an absolute value of the transfer bias applied to the third transfer member at the time the humidity detected by the detection device is equal to or larger than the value is larger than the absolute value of the transfer bias applied to the third transfer member at the time the humidity detected by the detection device is smaller than the value.

6. The image forming apparatus according to claim 2, wherein in the monochrome printing mode, the control unit is configured to control the second and third charging members so that the absolute value of the electric surface potential of the second image carrier is equal to the absolute value of the electric surface potential of the third image carrier.

7. The image forming apparatus according to claim 1 further comprising a detection device configured to detect humidity, wherein in the monochrome printing mode, the control unit is configured to control the second charging member so that the absolute value of the electric surface potential of the second image carrier at a time the humidity detected by the detection device is equal to or larger than a value is larger than the absolute value of the electric surface potential of the second image carrier at a time the humidity detected by the detection device is smaller than the value.

8. The image forming apparatus according to claim 7 further comprising:

a first transfer member configured to transfer a developer image formed on the first image carrier to the medium by a transfer bias whose polarity differs from a charged polarity of a developer on the first image carrier; and a second transfer member configured to transfer a developer image formed on the second image carrier to the medium by a transfer bias whose polarity differs from a charged polarity of a developer on the second image carrier, wherein in the monochrome printing mode, the control unit is configured to control the second transfer member so that an absolute value of the transfer bias applied to the second transfer member at the time the humidity detected by the detection device is equal to or larger than the value is larger than the absolute value of the transfer bias applied to the second transfer member at the time the humidity detected by the detection device is smaller than the value.

9. The image forming apparatus according to claim 1, wherein the control unit is configured to control the second charging member so that the absolute value of the electric surface potential of the second image carrier in the monochrome printing mode is larger than the absolute value of the electric surface potential of the second image carrier in the color printing mode.

10. The image forming apparatus according to claim 1, wherein the control unit is configured to control the first charging member so as to decrease the absolute value of the electric surface potential of the first image carrier.

11. The image forming apparatus according to claim 1, wherein the control unit is configured to control the second charging member so as to increase the absolute value of the electric surface potential of the second charging member.

* * * * *